US011113965B2

(12) United States Patent
Boutcher-West et al.

(10) Patent No.: US 11,113,965 B2
(45) Date of Patent: Sep. 7, 2021

(54) SYSTEM FOR OPTIMISING TRANSIENT KERBSIDE ACCESS

(71) Applicant: YELLOW LINE PARKING LTD., London (GB)

(72) Inventors: Ben Boutcher-West, London (GB); Stephen Jones, London (GB); John Fogelin, London (GB); Dan Hubert, London (GB)

(73) Assignee: YELLOW LINE PARKING LTD., London (GB)

( * ) Notice: Subject to any disclaimer, the term of this patent is extended or adjusted under 35 U.S.C. 154(b) by 0 days.

(21) Appl. No.: 17/009,917

(22) Filed: Sep. 2, 2020

(65) Prior Publication Data

US 2021/0074157 A1 Mar. 11, 2021

(30) Foreign Application Priority Data

Sep. 6, 2019 (EP) ..... 19196067

(51) Int. Cl.
*G08G 1/14* (2006.01)

(52) U.S. Cl.
CPC ..... *G08G 1/14* (2013.01)

(58) Field of Classification Search
CPC .. G06Q 10/02; G06Q 2240/00; G06Q 20/045; G06Q 20/32; G06Q 20/322; G06Q 20/3223; G06Q 20/3278; G06Q 20/38215; G06Q 20/3829; G06Q 30/06; G06Q 50/06; G06Q 30/0284; G06Q 20/102; G06Q 20/127; G06Q 20/325; G06Q 20/42; G06Q 10/06316; G06Q 10/20; G06Q 20/145; G06Q 20/202; G06Q 20/206; G06Q 20/209; G06Q 20/326; G06Q 20/3274; G06Q 20/3276; G06Q 30/016; G06Q 30/0185; G06Q 30/0282; G06Q 40/08; G08G 1/144; G08G 1/143; G08G 1/147; G08G 1/148; G08G 1/14; G08G 1/146; G08G 1/141; G08G 1/015; G08G 1/149; G08G 1/0129; G08G 1/0965; G08G 1/096725; G08G 1/096741; G08G 1/096775; G08G 1/096816; G08G 1/096838; G08G 1/096861; G08G 1/096866; G08G 1/096883; G08G 1/0969; G08G 1/142; G08G 1/145; G08G 1/162; G08G 1/168;
(Continued)

(56) References Cited

U.S. PATENT DOCUMENTS

2005/0280555 A1* 12/2005 Warner, IV ..... G08G 1/14 340/932.2
2015/0213715 A1* 7/2015 Schulz ..... G06F 16/29 340/932.2

(Continued)

*Primary Examiner* — Daniel Previl
(74) *Attorney, Agent, or Firm* — Greenberg Traurig, LLP

(57) ABSTRACT

For densely-populated cities in particular, finding suitable vehicle parking may often be problematic. Vehicles range widely in size and parking characteristics, drivers and passengers may have preferences and/or physical limitations for parking space features (such as needing a wide bay or to be within a certain proximity of a destination when they park due to limited mobility or due to delivery of a heavy or large item). According to aspects of the invention there is provided a computer-implemented system and method for dynamically serving parking space requests for a vehicle.

16 Claims, 6 Drawing Sheets

(58) Field of Classification Search
CPC ..... G08G 1/205; G07B 15/02; G07B 15/00; G07B 15/06; B60L 2240/80; B60L 53/65; B60L 2230/12; B60L 2230/34; B60L 2230/40; B60L 2240/622; B60L 2240/72; B60L 2250/10; B60L 53/14; B60L 53/16; B60L 53/18; B60L 53/30; B60L 53/31; B60L 53/57; B60L 53/665; B60L 53/68; B60L 2240/70; B60L 53/63; H04W 12/08; H04W 12/069; H04W 4/021; H04W 4/023; H04W 4/40; H04W 48/14; H04W 4/44; H04W 88/02; H04W 12/06; H04W 12/71; H04W 4/90; Y02T 10/70; Y02T 10/7072; Y02T 10/72; Y02T 90/12; Y02T 90/14; Y02T 90/16; Y02T 90/167; Y02T 90/169; Y04S 30/14; Y04S 10/126; Y04S 20/222; G07C 9/20; G07C 9/27; G07C 9/29; G07C 5/008; G07C 15/005; G07C 5/26; G07C 17/24; G07C 17/242; G07C 17/244; G07C 17/246; H04L 2209/56; H04L 2209/80; H04L 2209/84; H04L 63/0428; H04L 63/0442; H04L 63/0823; H04L 63/102; H04L 9/3247; H04L 9/3263; H04L 9/3268; H04L 63/0876; H04L 67/12; H04M 1/72412; G06F 16/951; G06F 16/29; G06F 13/42; G06F 16/9537; G06F 2213/40; G06F 9/44; G06F 9/00812; G06F 19/06037; G06F 2209/15; G06F 2209/23; G06F 9/00771; G06F 9/00778; G06F 9/00798; G06F 9/4604; B60R 1/00; B60R 2300/301; B60R 2300/308; B60R 2300/804; B60R 2300/806; B60T 2201/10; B62D 15/028; B62D 15/0285; G01S 19/51; G06T 11/60; G06T 2207/20076; G06T 2207/20081; G06T 2207/30264; G06T 7/60; G06T 7/80; B60W 2556/65; B60W 30/06; B60W 30/0956; B60W 60/0015; E04H 6/422; G01C 21/3407; G01C 21/3476; G01C 21/3682; G01C 21/3685; G05B 19/041; G05B 19/42; G05B 19/05; G05B 2219/2667; G05D 1/0212; G05D 1/0214; G05D 2201/0213; H02J 13/00022; H02J 13/0003; H02J 2310/48; H02J 7/0013; H02J 7/0027; Y02B 70/3225; Y02E 60/00
USPC ..... 340/932.2, 934, 691.6, 935, 938, 340/989–994, 995.1, 995.2, 427, 426.16, 340/426.22, 452, 588
See application file for complete search history.

(56) References Cited

U.S. PATENT DOCUMENTS

| | | | | |
|---|---|---|---|---|
| 2016/0189435 | A1 | 6/2016 | Beaurepaire | |
| 2016/0321715 | A1* | 11/2016 | Xu | H04W 48/14 |
| 2017/0148324 | A1 | 5/2017 | High et al. | |
| 2017/0206786 | A1 | 7/2017 | Dhondse et al. | |
| 2018/0130351 | A1* | 5/2018 | Ha | G06T 11/60 |
| 2018/0218605 | A1 | 8/2018 | Mowatt et al. | |
| 2018/0232958 | A1* | 8/2018 | Wang | G06Q 20/42 |
| 2018/0301031 | A1* | 10/2018 | Naamani | G06K 9/4604 |

* cited by examiner

SYSTEM FOR OPTIMISING TRANSIENT KERBSIDE ACCESS

BACKGROUND

For densely-populated cities in particular, finding suitable vehicle parking may often be problematic. Vehicles range widely in size and parking characteristics, and drivers and passengers may have preferences and/or physical limitations for parking space features (such as needing a wide bay, or to be within a certain proximity of a destination when they park due to limited mobility or due to delivery of a heavy or large item). As population sizes grow, the number of vehicles on the road increases, thereby presenting issues when current parking infrastructure reaches its limit and cannot adequately support additional vehicles. The issue is often linked to a number of factors, including the time of day, day of week, scheduled events, road closures, and others. Furthermore, a lack of parking may have further detrimental effects to the traffic flow of the local area, causing congestion, poorer air quality due to vehicle emissions, and general frustration. Suitable street parking in cities in particular may be difficult to locate unless known in advance, yet such parking may be the only suitable type of parking in some locations for some types of drivers or their passengers.

The embodiments described below are provided by way of example only and are not limiting of implementations which solve any or all of the disadvantages of known vehicle parking management systems or kerbside access management systems.

SUMMARY

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

According to an aspect of the invention there is provided a computer-implemented system for dynamically serving parking space requests for a vehicle. The system may comprise: one or more processors; a memory configured to store computer-executable instructions, which when executed on the one or more processors configures the system to provide: an input module for receiving a request for a parking space; a search module for determining a plurality of suitable parking spaces based on the received request, the determining comprising: selecting a region from a plurality of regions corresponding to a plurality of adjacent geographical areas, each of the regions being associated with an individual parking space prediction model adapted for that region, and the selection of the region being based on information derived from the request; utilising the parking space prediction model of the selected region to determine the plurality of suitable parking spaces based on the information derived from the request; an allocation module for selecting from the plurality of suitable parking spaces to allocate a parking space for the vehicle, the selection being performed based on a scoring a plurality of weighted selection criteria for each suitable parking space; a transmission module for transmitting data indicative of the allocated parking space.

In an embodiment of the invention, the information derived from the request comprises a feature vector indicative of vehicle intent, vehicle entitlement, and vehicle constraint features.

In an embodiment of the invention, the vehicle intent feature comprises data relating to one or more of a desired parking distance to a location, a physical dimension of the parking space, a type of parking space, duration of parking, a cost of parking, and time and/or date of parking.

In an embodiment of the invention, the vehicle entitlement feature comprises data relating to one or more of a parking permission status and a vehicle priority status.

In an embodiment of the invention, the vehicle constraint feature comprises data relating to one or more of a physical characteristic of the vehicle or a vehicle accessibility feature.

In an embodiment of the invention, the parking space prediction model is arranged to minimize a Euclidean distance between the feature vector comprising the request and a plurality of feature vectors representing the parking spaces located within the corresponding region and select a plurality of suitable parking spaces with the lowest vector distances.

In an embodiment of the invention, each parking space prediction model is associated with an individual computation agent.

In an embodiment of the invention, the selection criteria comprises one or more of an occupancy metric, a prediction metric, a congestion metric, a local air quality metric, an emissions metric, and a space efficiency metric.

In an embodiment of the invention, the occupancy metric is based on receiving dimension data of a vehicle presently occupying a suitable parking space, and estimating the remaining space in the suitable parking space.

In an embodiment of the invention, determining the space efficiency metric comprises calculating the likelihood that the space remaining in a parking space after occupancy by the vehicle can be used by other vehicles.

In an embodiment of the invention, the system further comprises an arbitration module arranged to: receive data indicative of a competing allocation of the final parking space by for a second request by a second vehicle; assign priorities to the vehicle and second vehicle based on their respective requests; re-select, for the vehicle with the lower assigned priority, from the plurality of suitable parking spaces to allocate an alternative parking space for said vehicle, the selection being performed based on a scoring a different plurality of weighted selection criteria for each suitable parking space.

In an embodiment of the invention, the system further comprises a verification module arranged to verify occupancy of the allocated parking space by the vehicle.

According to another aspect of the invention, there is provided a computer-implemented method for dynamically serving parking space requests for a vehicle, the method comprising: receiving a request for a parking space; determining a plurality of suitable parking spaces based on the received request, the determining comprising: selecting a region from a plurality of regions corresponding to a plurality of adjacent geographical areas, each of the regions being associated with an individual parking space prediction model adapted for that region, and the selection of the region being based on information derived from the request; utilising the parking space prediction model of the selected region to determine the plurality of suitable parking spaces based on the information derived from the request; selecting from the plurality of suitable parking spaces to allocate a final parking space for the vehicle, the selection being performed based on a scoring a plurality of weighted selection criteria for each suitable parking space; and transmitting data indicative of the allocated final parking space.

According to an embodiment of the invention, the method further comprises assigning priorities to the vehicle and a second vehicle responsive to receiving data indicative of a competing allocation of the final parking space by a second request for the second vehicle, and re-selecting, for the vehicle with the lower assigned priority, from the plurality of suitable parking spaces to allocate an alternative parking space for said vehicle, the selection being performed based on a scoring a different plurality of weighted selection criteria for each suitable parking space.

According to an aspect of the invention, there is provided a computer-readable comprising instructions which, when executed by a computer, cause the computer to carry out the above method.

There may be provided computer program code for performing any of the methods described herein. There may be provided non-transitory computer readable storage medium having stored thereon computer readable instructions that, when executed at a computer system, cause the computer system to perform any of the methods described herein.

The above features may be combined as appropriate, as would be apparent to a skilled person, and may be combined with any of the aspects of the examples described herein.

BRIEF DESCRIPTION OF THE DRAWINGS

Examples will now be described in detail with reference to the accompanying drawings in which.

Figure 1:
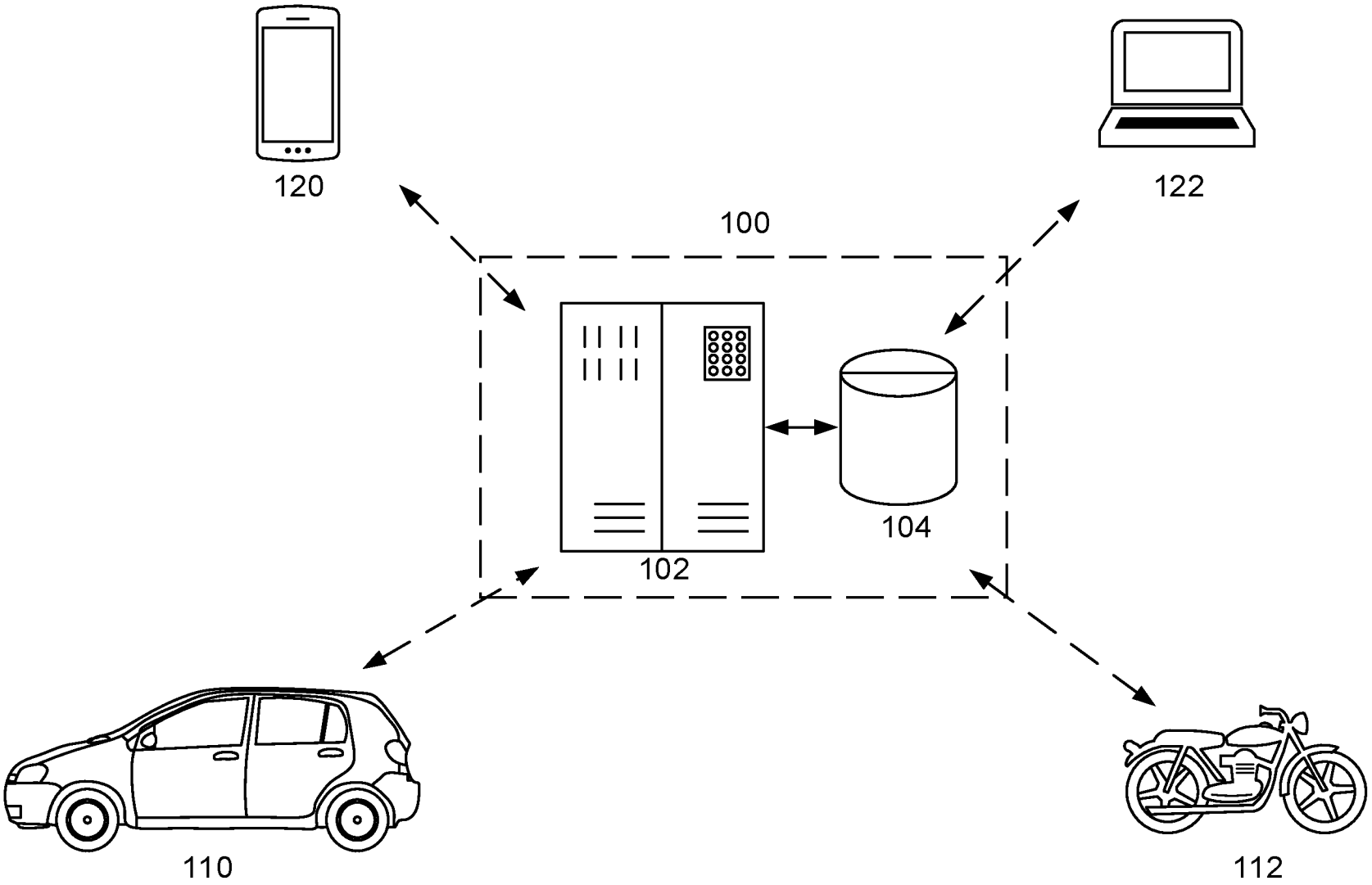
FIG. 1. is a schematic diagram of an example of a system for dynamically servicing parking space requests for a vehicle.

The accompanying drawings illustrate various examples. The skilled person will appreciate that the illustrated element boundaries (e.g., boxes, groups of boxes, or other shapes) in the drawings represent one example of the boundaries. It may be that in some examples, one element may be designed as multiple elements or that multiple elements may be designed as one element. Common reference numerals are used throughout the figures, where appropriate, to indicate similar features.

DETAILED DESCRIPTION

Finding and obtaining a parking space for a vehicle, particularly in a densely-populated area, is often an arduous task. Upon arriving at his or her destination, a user often must immediately manually search the surrounding area for a suitable space to park, wasting both time and effort in doing so. In addition, even when a parking space is identified, it can often be confusing as to whether it is available for parking for a particular vehicle as certain parking bays or kerbsides may be subject to access restrictions—for example based on vehicle type, time, or driver permissions. These access restrictions may further change regularly, adding to the complexity. Moreover, parking availability in a given area is often influenced by the time of day or day of week (e.g. parking availability is often low during peak times such as 8 am-6 pm, or Monday-Friday), and may be affected by external events (e.g. sports events or parades), which can exacerbate the problem. Overall, a lack of an efficient parking management system can lead to increased vehicle congestion in the surrounding area, higher vehicle emission levels, and can even cause disruptions to nearby buildings and residents (e.g. when a vehicle blocks a residential driveway). Furthermore, whilst a parking space may be available (and communicated as such) to a user or vehicle at the start of their journey, by the time the vehicle arrives the parking space may already be occupied. As such, there is a need for a system for efficiently allocating parking spaces to vehicles on a real-time basis whilst taking all of the above factors into account.

The following description is presented by way of example to enable a person skilled in the art to make and use the invention. The present invention is not limited to the embodiments described herein and various modifications to the disclosed embodiments will be apparent to those skilled in the art.

FIG. 1 illustrates an example of a system for dynamically serving a parking space request fora vehicle. A vehicle can comprise a car, motorcycle, bicycle, bus, lorry, or any other suitable means of transport. The system comprises a server or computing device 100 that includes a processor 102 and a memory 104 configured to execute or store instructions or other parameters to service parking requests. In some examples, the computing device 100 comprises a distributed system of one or more remote servers configured to establish wireless communications with communication interfaces in number of mobile communication devices, such as vehicles 110, 112 or user devices 120, 122, however, in other examples a different type of server platform provides equivalent functionality to that provided by the computing device 100 described in the examples herein. The memory 104 is provided by distributed memory system such as a cloud based system in some examples of the system, and need not be always co-located with other components of the computing device 100. Wireless communication between server 100 and mobile communication devices 110, 112, 120, 122 is provided via any suitable wireless communication protocol, such as Wi-Fi or any cellular communication protocol. In some examples of use of the system, instead of a mobile device 120, 122, a static computing device (not shown) brokers a parking space in respect of a moving vehicle with the server, in which case the computing device 100 establishes a suitable connection with the service requesting device (which could be via a landline data connection) as well as later or concurrently establishing a wireless connection with the vehicle 110, 112 for which the parking space is being brokered.

Figure 2:
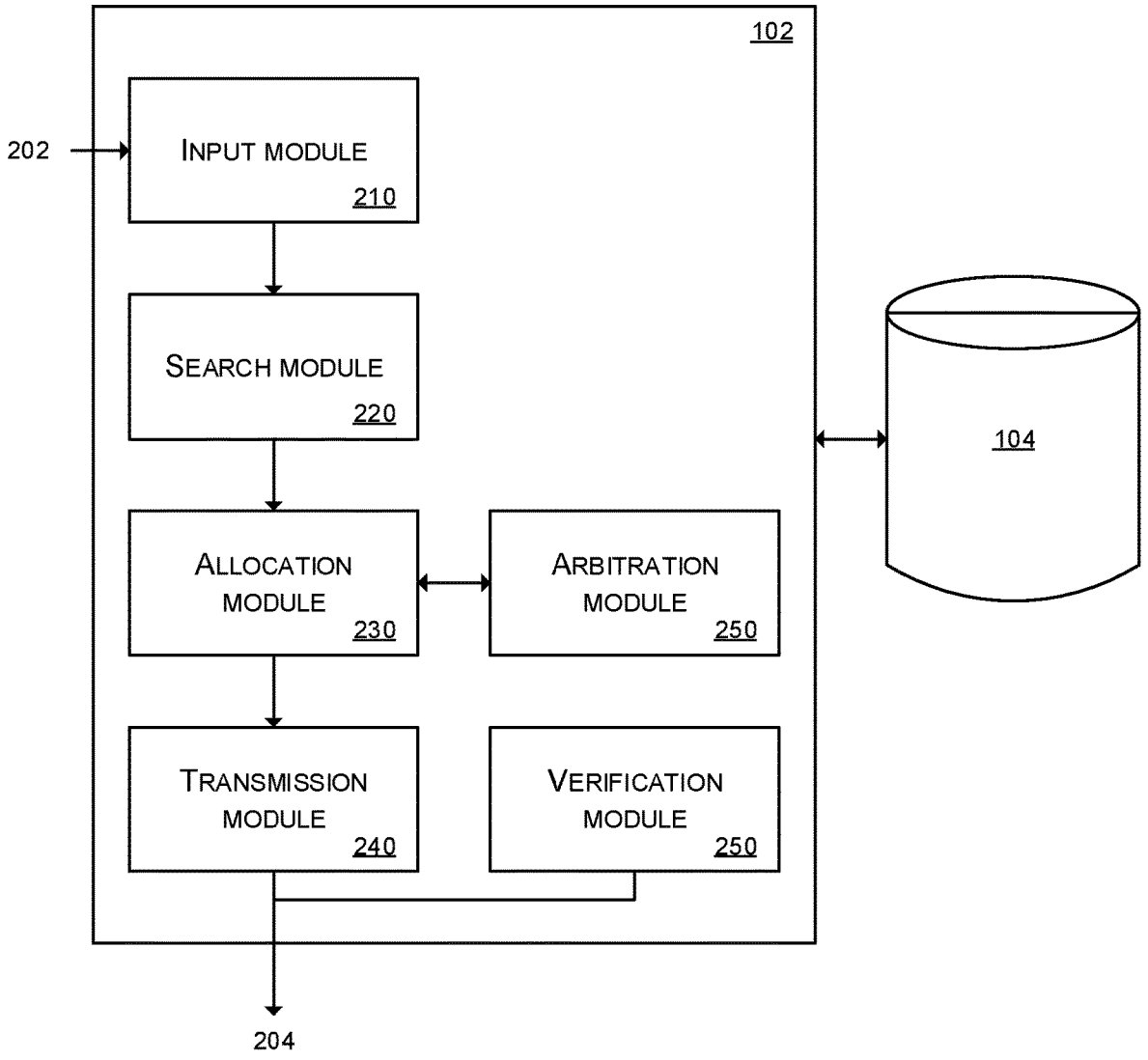
FIG. 2. illustrates an example system according to an embodiment of the invention.

FIG. 2 illustrates the processor 102 and memory 104 of the example computing device 100 shown in FIG. 1 in more detail. In the example shown in FIG. 2, the processor 102 comprises an input module 210, a search module 220, an allocation module 230, and a transmission module 240. In some embodiments, the processor 102 also comprises an arbitration module 250; however, in other examples, the arbitration module 250 is supported by a different physical processor to processor 102.

The input module 210 shown in FIG. 2 is configured to use any suitable wireless communication protocol to communicate with a mobile communication device 110, 112, 120, 122 responsive to receiving a parking allocation request 202 for a parking space from the mobile communication device over said wireless communication. Examples of a mobile communication device include any mobile device capable of establishing wireless communication with the input module 210, such as a smartphone, laptop, tablet, on-board computer of a vehicle, etc. The request may be manually initiated by a user, such as via an app on his or her smartphone, or via a website, or may be initiated automatically, such as by an on-board computer of a vehicle upon satisfying certain criteria (e.g. the vehicle entering a predesignated area). Notably, the input module 210 may receive multiple requests at a time for multiple vehicles, and as such may dynamically service multiple requests for a parking space concurrently. Resource management may be used to prevent overload if too many requests are received for simultaneous or overlapping processing.

The parking allocation service request 202 includes contextual data and/or contextual parameters which relate to the vehicle and/or to the type of parking being requested. In some embodiments, the parking allocation service request 202 comprises only a suitable vehicle identifier such as its vehicle registration number or number plate as contextual data and then retrieves additional contextual data and/or parameters, e.g. from stored memory. Examples of contextual data items include: a vehicle intent, a vehicle entitlement, and/or a vehicle constraint. A vehicle intent context item comprises information relating to the desired characteristics of the requested parking space. For example, a vehicle intent may include data relating to a requested location or intended destination of the vehicle, a requested upper bound and/or lower bound parking distance, a requested travel time between parking space location and the intended destination, a physical dimension of the requested parking space (e.g. a width of parking space), a physical topography of the parking space (e.g. includes a dropped kerb, special access requirements, degree of incline), a requested duration of parking, a maximum requested cost of parking, a requested time/date of parking, and/or an estimated travel time of the vehicle to the destination.

A vehicle entitlement includes information surrounding an access level of the vehicle for certain parking spaces. For example, a vehicle entitlement may include data relating to a parking permission status (e.g. if the vehicle is associated with a pre-purchased parking permit, or is eligible for disabled parking), and/or a vehicle priority status (e.g. if a level of priority should be allocated to the vehicle for a particular parking space, such as for ambulances/police cars).

A vehicle constraint context item comprises characteristics of the vehicle itself, for example, data describing a physical characteristic as a parameter/value pair (e.g. size, height, weight, occupancy, emission type, EV charge needs, self-parking abilities, door clearance requirements, etc.), and/or vehicle accessibility features (e.g. special access requirements).

In combination, the vehicle intent, vehicle entitlement, and/or vehicle constraint context items provides context to the parking space request 202, such that parking spaces may be more efficiently allocated based on the particular characteristics of the vehicle and that particular request. The data relating to the vehicle intent, vehicle entitlement, and/or vehicle constraint context items may correspond to limits to be imposed on the parking space to be allocated. For example, a vehicle constraint describing a width of the vehicle may correspond with a minimum width of the parking space to be allocated. The data relating to vehicle intent, vehicle entitlement, and/or vehicle constraint context items may in some examples be represented in the request 202 as one or more feature vectors. For example, an n-dimensional vector of numerical features may be included in a request that represents the complete context of the request. In some embodiments, the feature vector is weighted, which enables certain features of the request to be prioritised in the following search and allocation steps. However, it will be appreciated that the request may comprise also non-numerical data relevant to the request 202, such as string data or graph data. As previously mentioned, the request may simply comprise a vehicle identifier which allows context items to be retrieved from memory by the computing device 100, for example, a look-up operation may be performed from a local or remote memory/data store. In addition, it will be appreciated that any other suitable data structure, such as an object or tree, may be used to represent the request 202.

Upon receipt of the parking space request by the input module 210, in some embodiments the input module 210 stores at least a subset of the request data in memory 104. This allows a request to be efficiently retrieved by the computing device 100 for future requests, and avoids the need to retransmit all or part of the request data 202 for a vehicle.

Subsequently, the request 202 for a parking space is then forwarded to the search module 220 in order to determine a plurality of suitable parking spaces based on the data in the request 202 or information derived from the request 202.

In some examples, the memory 104 comprises a database of parking spaces and their attributes which may be used to extract a list of suitable parking spaces which match the parameters of the request. However, it will be appreciated that traditional brute-force search algorithms applied to a central database are often inefficient and untenable as the required computation load is high for large databases, meaning such systems cannot serve parking space requests within a fast-enough time-frame for real-time applications. In addition, given the constant flux of parking space occupancy, combined with the need to service multiple parking space requests all with different request parameters simultaneously, traditional systems are unable to cope with being responsive enough to dynamically and accurately determine which parking spaces are available to a vehicle. For example, depending on demand and the scale of the region being serviced by a system, concurrently performing searches for allocating a parking space for a large number of vehicles, for example, hundreds (in a small town) to thousands to hundreds of thousands (for a major city where traffic is on a scale such as London or Paris or the like) is required. Requests which are received simultaneously and/or require concurrent processing by the parking system place a demand on system resources in several ways. For example, the system should have sufficient processing ability to concurrently process and/or queue for an acceptable amount of time all received parking requests, which requires processing power and memory to be appropriately dimensioned for the relevant number of requests expected to be received at peak times. The time taken to service a request also affects the system throughput, as in some instances, the parking availability is sufficiently dynamic for current parking availability to change during the time taken to service a request. Accordingly, as requests are serviced, the database of available parking spaces is updated between each request in a much shorter amount of time than that taken to service a request to minimise the number of conflicting allocations of the same parking space which might otherwise occur as each request requires a certain amount of time to complete. The present invention thus seeks to mitigate these problems by using a novel search approach, described below.

Figure 3:
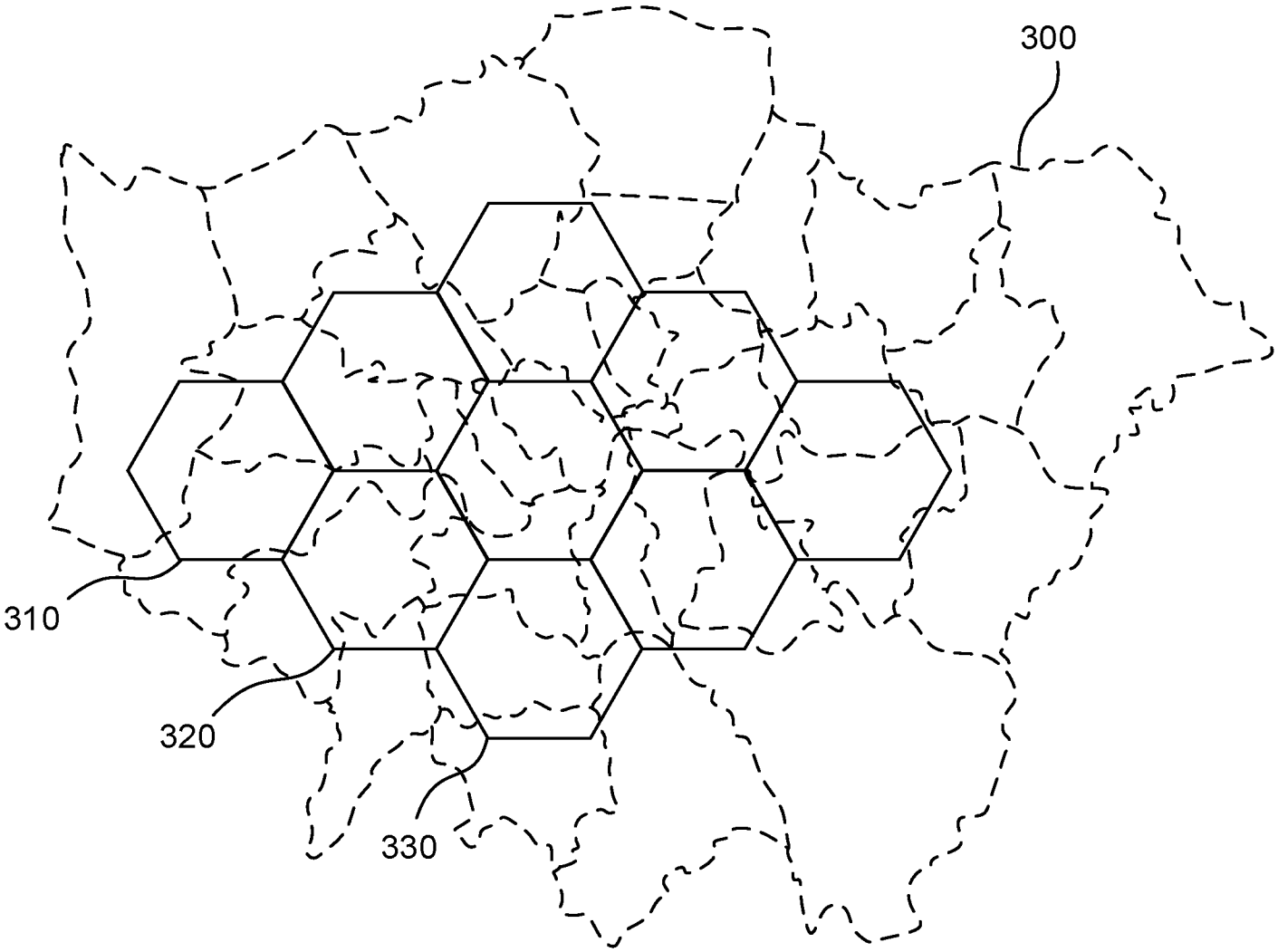
FIG. 3. illustrates a plurality of regions as used by the example system of FIG. 2.

In order to provide an efficient method of searching for a plurality of available parking spaces, the search module 220 is first arranged to select a region from a plurality of non-overlapping adjoining regions, for example, tessellated regions, corresponding to a plurality of adjacent geographical areas for which parking space data is available. The selection of the region may be performed based on the parameters of the request, such as by utilising destination data relating to the request. An example representation of the regions is shown in FIG. 3, which depicts a plurality of tessellated regions 310, 320, 330 overlaid onto a mapped space 300. It will be appreciated that the map 300 is for illustrative purposes, and represents the total geographic area for which parking space data is stored in memory 104.

In some embodiments, parking regions may alternatively follow administrative boundaries (such as may be defined by a municipality), geographic boundaries (for example, a river boundary or border) and/or be a mix of different types of regions (for example, a county border may be internally tessellated). In effect, the regions 310, 320, 330 represent how the parking space data is being partitioned in memory. Each region 310, 320, 330 is associated with parking space data for the enclosed geographical area as indicated by the map 300. Although FIG. 3 only illustrates nine regions, it will be appreciated that in operation the number of regions may be significantly more, and the plurality of regions may extend to cover all of the map 300. Furthermore, FIG. 3 shows the regions 310, 320, 330 as being hexagonally-shaped, however it will be appreciated that one or more suitable shapes may be used in some embodiments to tessellate and/or otherwise partition a geographical area into non-overlapping adjoining regions. Region data may be stored in and accessed from the memory 104.

According to the embodiments of the invention, each region 310, 320, 330 is further associated with a separate, individual parking space prediction model adapted for that region. In such embodiments, the search module 220 is arranged to utilise a parking space prediction model to determine a plurality of suitable parking spaces fora particular region based on the request 202. Each individual parking space prediction model is used to computationally model the parking space availability for its associated region 310, 320, 330. In some embodiments, a parking space prediction model is associated with multiple regions. In some embodiments, the parking space prediction model utilises stored data relating to each parking space located within its associated geographical area to determine suitable parking spaces. The parking space prediction model may be arranged to update the stored data based on new parking space data received in real-time. However in other embodiments the parking space prediction model is arranged to determine a plurality of suitable parking spaces based only on stored data relating to each parking space, in order to improve processing times. In some embodiments, the search excludes what might otherwise be possible parking spaces from being searched and/or indicated as possible spaces in the search results where one or more exclusion reasons are already known by the search system. For example, in some embodiments, unavailable parking spaces are automatically excluded from the set of parking spaces searched where this is known at the time a search query is being processed. This is effectively a pre-filtering of available parking spaces as fewer available parking spaces are then searched. However, in addition or as an alternative, in some embodiments the search results are filtered to confirm parking space availability. If the search results include unconfirmed (and so only potentially) available parking spaces, these are then checked for reservations and/or actual occupancy, to post-filter the search results to only available parking spaces. Post-filtering to confirm availability provides a more recent and potentially more reliable indication of actual availability, which may be better suited for some street parking environments than pre-filtering. Parking space availability can be determined based on a known parking space booking and/or on an actual occupancy check. An occupancy check has a higher trust level than a booking reserving a space and is weighted accordingly in some embodiments. In some embodiments a space is excluded as an available space if it is known to be already booked out fora certain period of time and/or excluded based on a predicted availability derived from some other source, for example, based on historical information and/or unknown occupancy of that space and/or other adjacent spaces and/or other possible matches. Occupancy is not processed until the allocation stage in some embodiments to speeds up the processing and allows more factors (than simply availability) to be weighed in the space allocation decision making process. This allows the search stage to initially match up suitable parking spaces without taking account of predictive factors. In some embodiments, multiple contiguous parking spaces may be amalgamated and presented as a single parking space, for example in cases where a vehicle constraint indicates a vehicle is larger than a single parking space (e.g. for lorries, trucks, buses, etc.). If the total area of multiple adjacent parking spaces is determined to be suitable for the vehicle, the multiple individual parking spaces may be identified as a single large suitable parking space. In some embodiments, the parking space prediction model may be arranged to output a ranked list of suitable parking spaces, wherein the parking spaces are ranked according to their predicted availability.

In some embodiments, the parking space prediction model may comprise a simulation agent arranged to simulate the availability of parking spaces for a given time frame in order to determine the plurality of likely suitable parking spaces for that time frame. The simulation may be based on historical data or future data, and may take into account both previous parking space occupancy data and future scheduled events such as road closures, sports events, etc. The simulation agent may simulate the flow of traffic within a region 310, 320, 330. Each region 310, 320, 330 may also pass and receive simulation data to and from the parking space prediction models of neighbouring regions, such that the computed parking space availability of a particular region is at least partly based on the simulation data of one or more of its neighbouring regions. In one embodiment, each region 310, 320, 330 may pass and receive simulated vehicle traffic flow data to and from one or more neighbouring regions.

In some embodiments, the parking space prediction model is arranged to filter out parking spaces which do not meet requirements as indicated by the received vehicle intent, vehicle entitlement, and/or vehicle constraint context items. In some embodiments, each parking space prediction model is arranged to minimise a Euclidean distance between one or more of the feature vectors comprising the request and one or more stored feature vectors representing the parking spaces located within the corresponding region. The parking space prediction model may be arranged to output one or more parking spaces with a Euclidean vector distance that are below a pre-determined threshold. In some embodiments, the search for suitable parking spaces is performed via a hill-climbing algorithm, which seeks to select an optimally suitable parking space by seeking a minimum vector distance, however any suitable search algorithm may be used to output a suitable parking space. As the nature of parking is inherently chaotic and in a constantly-changing state of flux, the search algorithm may be arranged to only operate for a fixed period of time in order to preserve the responsiveness of the system. Thus in some embodiments, the search algorithm returns the optimal results found within a cut-off time period. In other embodiments, the search algorithm is arranged to restart if no results are found with a vector distance below a certain threshold after a predetermined amount of time. Each parking space is scored according to its vector distance to the request, and ranked according to the resulting score.

In some embodiments, each parking space prediction model is associated with an individual computation agent, such as a processor thread, processor, server, or computing cluster, such that parking space availability predictions for each region may be computed independently of one another.

Advantageously, by segregating a search area into regions 310, 320, 330 and assigning each region an individual parking space prediction model for search operations, the system is able to scale for servicing large numbers of simultaneous parking space requests. Decision-making is decentralised and performance is thereby improved. Furthermore, providing a plurality of suitable parking spaces allows for dynamic rerouting, i.e. dynamic re-allocation of a parking space in the event that a parking space becomes occupied.

Once a plurality of suitable parking spaces is identified, the allocation module 230 is arranged to select a final parking space for the vehicle from the plurality of suitable parking spaces. Selection of the final parking space may be based on scoring a plurality of selection criteria for each suitable parking space. In some embodiments, the scoring of the selection criteria is based on the request. For example, the information provided in the request may be used to determine the scoring of one or more of the selection criteria.

Figure 4:
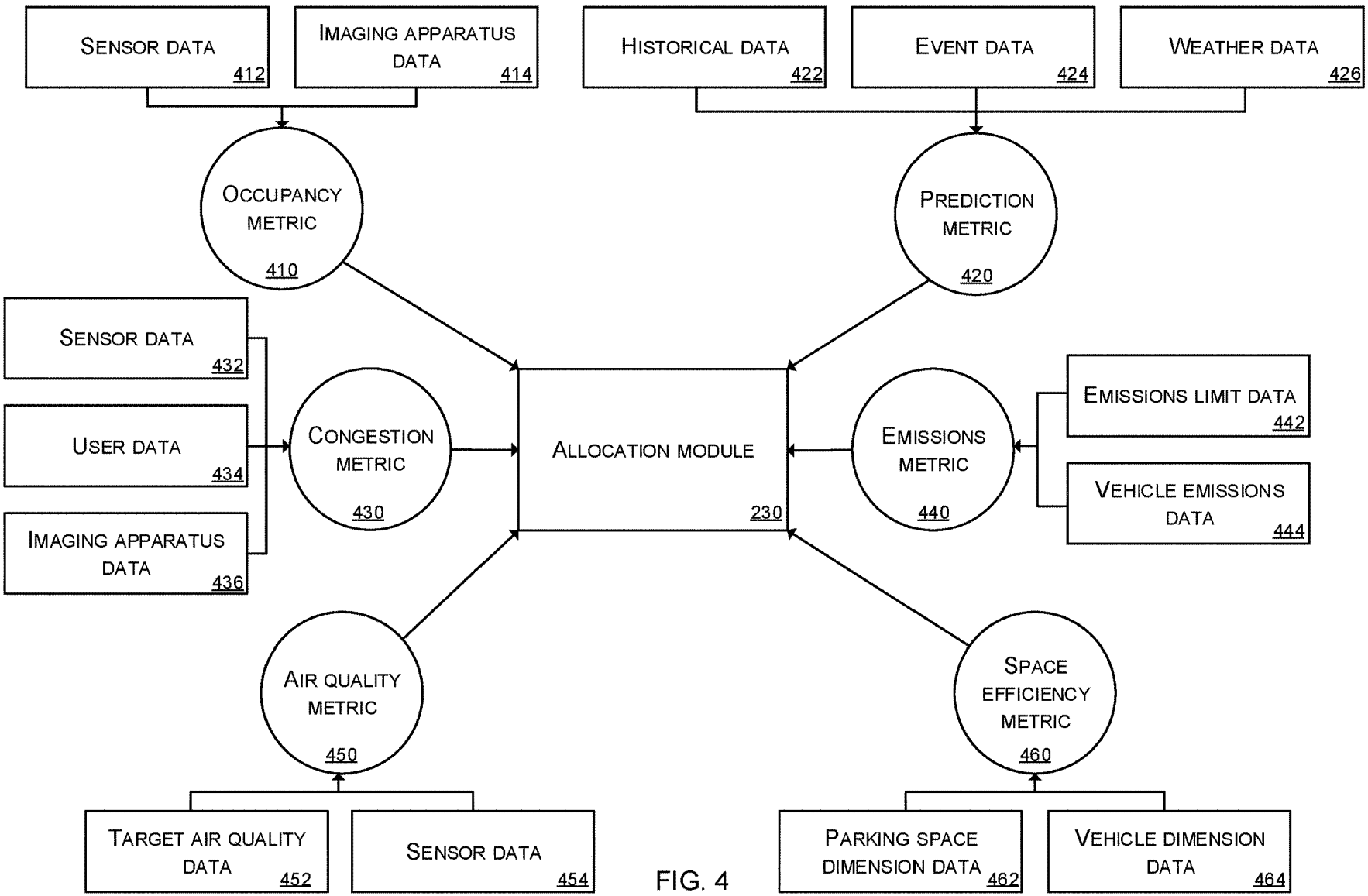
FIG. 4. Illustrates an example architecture of the allocation module of FIG. 2 according to an embodiment of the invention.

FIG. 4 shows the allocation module 230 in more detail, and illustrates a non-limiting example of the selection criteria 410, 420, 430, 440, 450 that is scored to select the final parking space.

In some embodiments, one of the selection criteria comprises an occupancy metric 410, and selection of a final parking space further comprises receiving a current state estimation for each suitable parking space in order to determine the occupancy metric. The current state estimation may comprise a real-time indication of the current occupancy or availability of the parking space. In some embodiments, the current state estimation may be provided by stored data relating to previously allocated parking spaces by the system. In some embodiments, the current state estimation is received from physical sensors 412 located at each parking space arranged to determine whether the parking space is currently occupied. Examples of sensors include Bluetooth or infra-red (IR) sensors positioned at each parking space and arranged to detect the presence of a vehicle, although it will be appreciated that any suitable sensor may be used. In some embodiments, the current state estimation is received from imaging apparatus 414 arranged to apply computer vision techniques in order to detect the presence of a vehicle on a parking space. In some embodiments, the current state estimation may is received from other mobile devices, such as other user smartphones. A current state estimation indicating a likely occupancy of a suitable parking space will provide a high occupancy metric score 410, which will influence the selection of that suitable parking space as the final parking space. For example, parking spaces with high occupancy scores may be less likely to be allocated as the final parking space.

In some embodiments, determining the occupancy metric may also take into account received dimension data of an occupying vehicle (or other obstruction) in a parking space. For example, consider where a relatively large parking space (e.g. 6 m in length or width) is occupied by a small vehicle (e.g. 2 m in length or width). This leaves some of the available space unoccupied (e.g. 4 m). In this example, the occupancy metric is determined by estimating whether the remaining space in the parking space is suitable for the vehicle issuing the request based on the dimension data of the presently occupying vehicle. If the estimation indicates that there is some remaining parking space available for another vehicle (e.g. large enough for occupancy by both the presently occupying vehicle and the requesting vehicle), the parking space may be presented as a suitable final parking space and may still be issued a low or lower occupancy score. The occupancy metric may also be based on a door clearance requirement or self-parking ability of the occupying or requesting vehicle. For example, where a driver is able to exit the vehicle before initialising parking (e.g. in situations where a vehicle has an autonomous self-parking ability), the occupancy metric may be scored differently (e.g. lower) as the required space for the vehicle is smaller, than it would be scored if the vehicle required additional clearance to allow the driver to exit the vehicle after parking. Adjacent parking spaces may also be concatenated together suitably to create additional spaces if not fully occupied.

In some embodiments, one of the selection criteria comprises a prediction metric 420, and selection of a final parking space further comprises using a predictive algorithm to determine a predicted availability of each of the suitable parking spaces. The predictive algorithm comprises any suitable machine learning algorithm arranged to process historical parking data 422 and provide predictions of the likelihood of future availability of a particular parking space at the requested parking time. The predictive algorithm may utilise trend analysis or pattern recognition. In some embodiments, the predictive algorithm takes into account the requested parking time indicated in the request, and also factor in event data 424 indicative of scheduled future events, such as street closures, public holidays, the finishing of a theatre performance, sporting events, etc. In some embodiments, the predictive algorithm factors in weather data 426. The algorithm may comprise a neural network, however it will be appreciated that any suitable predictive algorithm may be used.

In some embodiments, one of the selection criteria comprises a congestion metric 430, and selection of the final parking space further comprises receiving an indication of the current vehicle congestion level surrounding a suitable parking space. Indications of the congestion level may be received from sensors 432, user input 434, imaging apparatus 436, externally provided APIs, or otherwise. It is generally desirable to ease congestion where possible, and thus parking spaces located in areas of high congestion may be assigned a lower score according to the congestion metric 430 such that they are less likely to be allocated as the final parking space. In addition, requests indicating that the vehicle has a high occupancy capability (e.g. buses) may raise the scoring of a congestion metric 430 such that the parking is space is more likely to be allocated.

In some embodiments, one of the selection criteria comprises an emissions metric 440, and selection of the final parking space further comprises receiving an indication of a vehicle emissions limit 442 of the parking space. Requests comprising vehicle emissions data 444 indicating that the vehicles has an emissions level that exceed the emissions limit 442 may cause the emissions metric 440 be assigned a lower scoring such that the parking is space is less likely to be allocated.

In some embodiments, one of the selection criteria comprises a local air quality metric 450, and selection of the final parking space further comprises receiving an indication of a target air quality level 452 surrounding a suitable parking space, as well as a current air quality level. The indications of current air quality levels may be received in real-time from air quality sensors 454 located in proximity to the suitable parking spaces, externally provided APIs, or otherwise. Parking spaces where the target air quality level has not been met may be scored lower according to the air quality metric 450 such that they are less likely to be allocated as the final parking space.

In some embodiments, one of the selection criteria comprises a revenue metric, and selection of the final parking space further comprises receiving an indication of a target revenue of the parking space, as well as historically received revenue. Parking spaces where revenue targets have not been met may be scored higher according to the revenue metric such that they are more likely to be allocated as the final parking space.

Figure 5A:
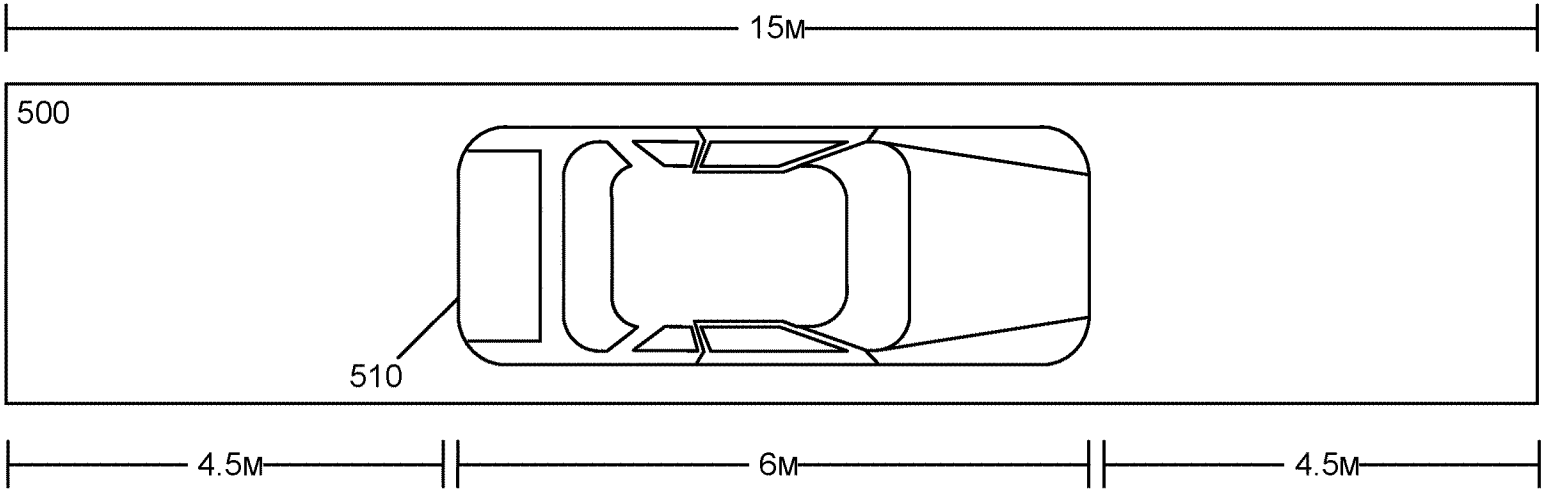
FIGS. 5A and 5B illustrate an example space efficiency calculation according to an embodiment of the invention.
Figure 5B:
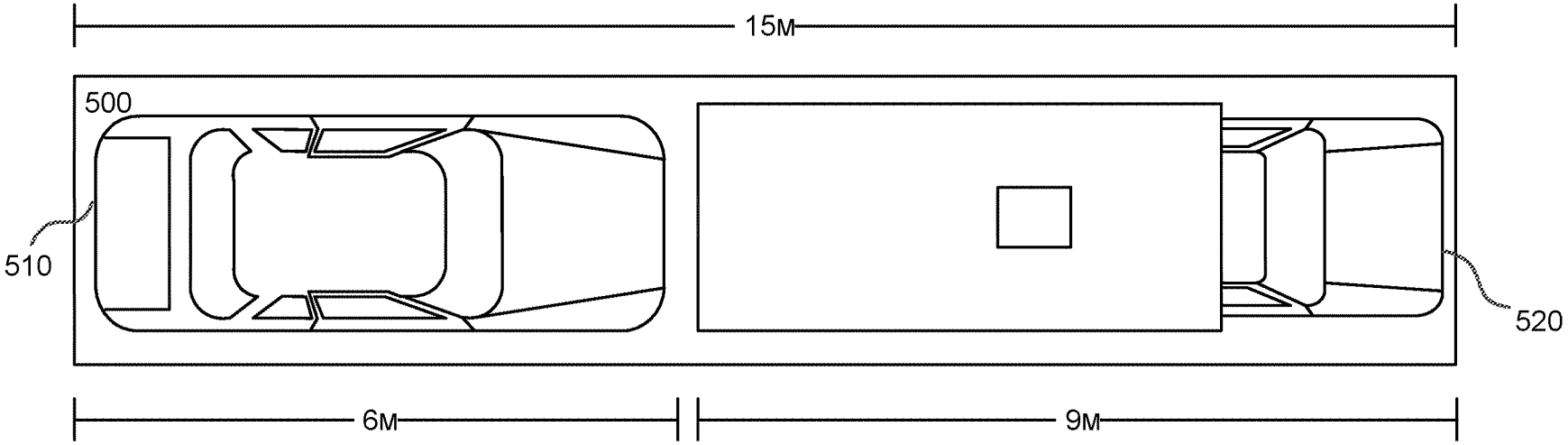

In some embodiments, one of the selection criteria comprises a space efficiency metric 460, and selection of the final parking space further comprises receiving, estimating, or calculating a space efficiency of the parking space given occupancy by the requesting vehicle. The space efficiency metric comprises an indication of how efficiently a parking space can be utilised by the requesting vehicle such that any remaining space is maximised for other vehicles. Determining the space efficiency metric comprises calculating the likelihood that the space remaining in a parking space after occupancy by a vehicle can be used by other vehicles based on dimension data of the parking space 462 and of the requesting vehicle 464. For example, FIG. 5A shows the consideration of a parking scenario in which 15 metres of contiguous parking space 500 is available. The parking space 500 may comprise multiple individual parking spaces amalgamated together. A mid-size vehicle 510 of 6 metre length may subsequently be allocated to a 6 m space directly in the middle of the 15 m parking space 500. However, it will be appreciated that this parking allocation is inefficient, as it splits the remaining space into two 4.5 m sections on either side of the vehicle 510, which may thus only be used by vehicles of less than 4.5 m in length (which may be less common, and thus the likelihood of use of the remaining space by other vehicles is lower). A low space efficiency metric would thus be calculated for this scenario. Figure SB again shows the consideration of a parking scenario in which 15 m of contiguous parking space is available, however the mid-size vehicle 510 is allocated to the end of the contiguous parking space 500. This configuration allows for 9 m of remaining parking space, which can be used to fit large-size vehicle 520, for example. Thus, two vehicles are more likely to efficiently use the parking space 500. A high space efficiency score may be calculated for this parking space allocation of the vehicle 510. Higher efficiency scores may be calculated for more efficient parking space allocations such that the parking space is more likely to be allocated as the final parking space. Again, the determination may be based on factors such as self-parking abilities and/or door clearance which will affect a vehicle's dimension data. The use of a space efficiency metric in determining the final parking space allocation realizes greater parking density, and thus more efficient resource utilisation.

In some embodiments, selection criteria may take into account factors such as the sequence in which shared a parking areas is to be occupied, and how the available parking is accessed, so as to seek to maximise the fill occupancy of available parking areas. Vehicle access may be based on factors such as if access to the vehicle is obstructed on one or more sides of the actual parking space, and if the obstruction is temporary (for example, another parked vehicle) or permanent (e.g. a street lamp or wall). Other factors which are taken into account in some embodiments include the potential for a different parking orientation of a vehicle in a bay (for example, a number of motorcycles or short cars may park transverse to the orientation a larger vehicle may park in within a parking space). Finally, as mentioned above, the physical dimensions of a number of vehicles which could in combination fill an available parking space to a larger extent than other combinations may be taken into account, given the sequence of their intended times of arrival and/or departure according to their booking. Finally, parking spaces may be allocated taking into account a vehicle's turning circle, height, and other dimensions which might affect its ability to access a parking space in addition to its length and width.

It will be appreciated that any number of selection criteria and metrics may be used.

As noted, selection of the final parking space may be based on scoring the plurality of selection criteria 410, 420, 430, 440, 450, 460 for each suitable parking space. In some embodiments, the selection criteria 410-460 is weighted, such that certain criteria have higher influence on the scoring than others. The selection criteria 410-460 may change dynamically, such that the selection criteria between different requests are not identical. The final parking space may be selected based on the suitable parking space with the highest or lowest scoring.

Once a parking space is allocated to a first request by a first vehicle, the system may receive indication of a competing allocation of the final parking space by a second request for a second vehicle. In such instances, in some embodiments the arbitration module 250 is arranged to assign priorities to the first request and the second request and re-select using the allocation module 240, for the vehicle with the lower assigned priority, an alternative parking space for said vehicle from the plurality of suitable parking spaces. The re-selection may be performed based on a scoring of a different plurality of weighted selection criteria. The original final parking space is assigned to the request with the higher priority. Priorities may be assigned according to the parameters of the request. For example, a vehicle indicating an ambulance vehicle type may be assigned a higher priority than a vehicle indicating a taxi vehicle type.

The allocation of the parking space may in some situations be rejected by the vehicle or the operator of the vehicle. Alternatively, the allocated final parking space may become unexpectedly occupied. In either case, an alternative parking space is consequently re-allocated from the plurality of suitable parking spaces. Alternatively, a new request may be transmitted by the vehicle for servicing by the computing device 100. The new request may comprise different vehicle context items. Optionally, the re-allocation is performed using different selection criteria.

Once a final parking space is allocated to a request for a vehicle, stored occupancy data relating to that parking space may be updated to indicate that the parking space is occupied. In situations where a final parking space comprises a part of a whole parking space (e.g. in situations where the vehicle size does not fully occupy the allocated parking space), occupancy data relating to one or more of the occupied section of the parking space and the remaining free section of the parking space may be updated and stored in memory 104 for use in future allocations. For example, the remaining free space of the parking space may be used to allocate a parking space to a second vehicle. In particular, this dynamic partitioning of parking spaces advantageously realises greater parking density, and thus more efficient resource utilisation.

Once a final parking space is allocated to a request for a vehicle, the transmission module 240 may be arranged to transmit data indicative of the final parking space to the mobile communication device 110, 112, 120, 122 from the server 100. The data indicative of the final parking space may comprise a location of the final parking space, such as GPS co-ordinates. The data indicative of the final parking space may comprise turn-by-turn navigation instructions to guide the vehicle to the parking space. In situations where the allocation of a parking space is contested and the arbitration module 250 assigns the vehicle an alternative final parking space, the transmitted data is updated to reflect the new final parking space and the navigation instructions may be updated dynamically accordingly.

In some embodiments, once the vehicle arrives at the final parking space, a verification module 250 is arranged to verify occupancy of the final parking space by the vehicle. Occupancy may be confirmed via receiving occupancy data at the verification module 250 from sensors located at the parking space, or imaging apparatus utilising computer vision techniques to detect parking space occupancy. Occupancy may also be confirmed by receiving a GPS (or other locale determination sensing) location of the vehicle at the server and matching the GPS location to the location of the parking space. In some embodiments, occupancy may be confirmed by measuring a wireless signal strength of a mobile communication device and confirming the location of the device using trilateration or triangulation.

Figure 6:
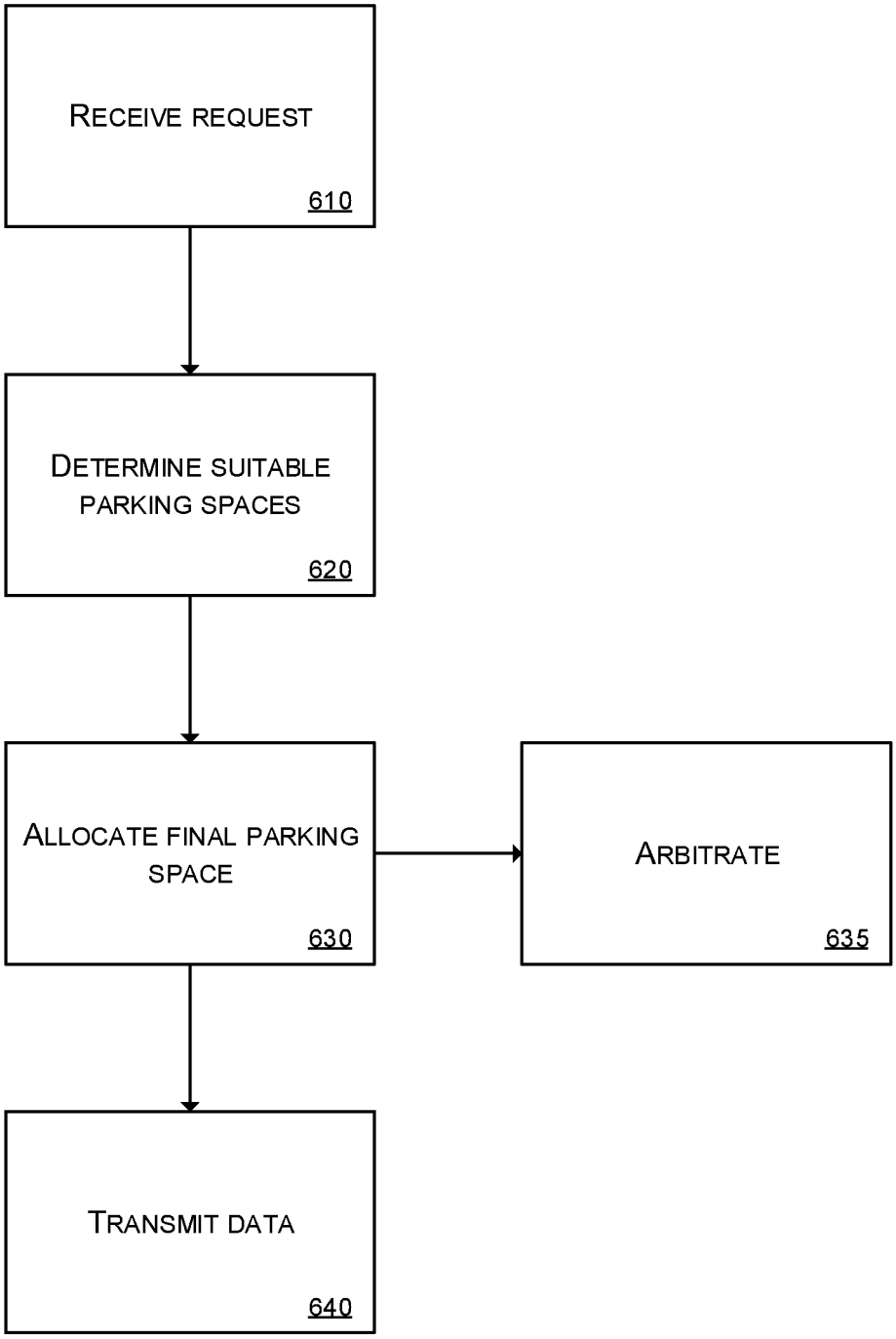
FIG. 6 illustrates an example of a method according to the invention.

FIG. 6 illustrates a computer-implemented method 600 for dynamically servicing parking space requests for a vehicle, according to the present invention. The method 500 may be implemented by the system 100 for example, by the system shown in FIG. 1.

In step 610, a request for a parking space is received. The request may be received from a mobile communication device such as a smartphone, laptop, tablet, on-board computer of a vehicle, or otherwise. The request may be manually initiated by a user, such as via a n app on his or her smartphone, or via a website, or may be initiated automatically, such as by an on-board computer of a vehicle upon satisfying certain criteria (e.g. the vehicle entering a predesignated area). Multiple requests may be received at a time for multiple vehicles, and as such multiple requests for parking spaces may be serviced by the method simultaneously.

In some embodiments, the request comprises contextual data or contextual parameters surrounding the vehicle and the request. The request 202 may comprise a vehicle intent, a vehicle entitlement, and/or a vehicle constraint. The data relating to vehicle intent, vehicle entitlement, and/or vehicle constraint may be represented in the request as a feature vector, e.g. as an n-dimensional vector of numerical features that represent the context of the request. The feature vector may be weighted, such that certain features of the request are prioritised in the following search and allocation steps. However, it will be appreciated that the request may comprise also non-numerical data relevant to the request, such as string data or graph data. In addition, it will be appreciated that any other suitable data structure, such as an object or tree, may be used to represent the request.

Optionally, a subset of the request data is stored for future retrieval for future requests by the vehicle.

In step 620, a plurality of suitable parking spaces is determined based on the received request. A region is selected from a plurality of regions corresponding to a plurality of adjacent geographical areas. The selection of the region is performed based on the parameters of the request, such as by utilising destination data relating to the request. Each region is associated with a separate, individual parking space prediction model adapted for that region. A parking space prediction model is utilised to determine the plurality of suitable parking spaces for a particular region based on the request. In some embodiments, the parking space prediction model may be arranged to output a ranked list of suitable parking spaces, wherein the parking spaces are ranked according to their predicted availability.

In step 630, a final parking space is allocated for the vehicle by selecting from the plurality of suitable parking spaces. The selection is performed based on scoring a plurality of selection criteria, for example those described previously, for each suitable parking space. The selection criteria may be weighted. In some embodiments, the selection criteria changes dynamically, such that the selection criteria between different requests are not identical. The final parking space may be selected based on the suitable parking space with the highest or lowest scoring.

In some embodiments, in step 635, data indicative of a competing allocation of the final parking space by a second request for a second vehicle may be received. In such instances, priorities are assigned to the vehicle and second vehicle based on their respective requests, and an alternative parking space is re-selected for the vehicle with the lower assigned priority from the plurality of suitable parking spaces. The selection may be based on scoring a different plurality of weighted selection criteria for each suitable parking space.

Optionally, the occupancy of the allocated parking space by the vehicle is verified and confirmed. Occupancy may be confirmed via receiving occupancy data at the verification module 250 from sensors located at the parking space, or imaging apparatus utilising computer vision techniques to detect parking space occupancy. Occupancy may also be confirmed by receiving a GPS location of the vehicle at the server and matching the GPS location to the location of the parking space. Occupancy may be confirmed by measuring a wireless signal strength of a mobile communication device and confirming the location of the device using trilateration or triangulation.

In step 640, data indicative of the final parking space is transmitted to the mobile communication device. The data indicative of the final parking space may comprise a location of the final parking space, such as GPS co-ordinates. The data indicative of the final parking space may comprise turn-by-turn navigation instructions to guide the vehicle to the parking space. In situations where the allocation of a parking space is contested and the vehicle is assigned an alternative final parking space, or in situations where the allocated final parking space becomes unexpectedly occupied, the transmitted data is updated to reflect the new final parking space and the navigation instructions may be updated dynamically accordingly.

In an embodiment, computer executable instructions may be provided using any computer-readable media that is accessible by computing device 102. Computer-readable media may include, for example, computer storage media such as memory 104 and communications media. Computer storage media (i.e. non-transitory machine readable media), such as memory 104, includes volatile and non-volatile, removable and non-removable media implemented in any method or technology for storage of information such as computer readable instructions, data structures, program modules or other data. Computer storage media includes, but is not limited to, RAM, ROM, EPROM, EEPROM, flash memory or other memory technology, CD-ROM, digital versatile disks (DVD) or other optical storage, magnetic cassettes, magnetic tape, magnetic disk storage or other magnetic storage devices, or any other non-transmission medium that can be used to store information for access by a computing device. In contrast, communication media may embody computer readable instructions, data structures, program modules, or other data in a modulated data signal, such as a carrier wave, or other transport mechanism. As defined herein, computer storage media does not include communication media. Although the computer storage media (i.e. non-transitory machine readable media, e.g. memory 104) is shown within the computing-based device 102 it will be appreciated that the storage may be distributed or located remotely and accessed via a network or other communication link.

Those skilled in the art will realize that storage devices utilized to store program instructions can be distributed across a network. For example, a remote computer may store an example of the process described as software. A local or terminal computer may access the remote computer and download a part or all of the software to run the program. Alternatively, the local computer may download pieces of the software as needed, or execute some software instructions at the local terminal and some at the remote computer (or computer network). Those skilled in the art will also realize that by utilizing conventional techniques known to those skilled in the art that all, or a portion of the software instructions may be carried out by a dedicated circuit, such as a DSP, programmable logic array, or the like.

The methods described herein may be performed by a computer configured with software in machine readable form stored on a tangible storage medium e.g. in the form of a computer program comprising computer readable program code for configuring a computer to perform the constituent portions of described methods or in the form of a computer program comprising computer program code means adapted to perform all the steps of any of the methods described herein when the program is run on a computer and where the computer program may be embodied on a computer readable storage medium. Examples of tangible (or non-transitory) storage media include disks, thumb drives, memory cards etc. and do not include propagated signals. The software can be suitable for execution on a parallel processor or a serial processor such that the method steps may be carried out in any suitable order, or simultaneously.

It will be understood that the benefits and advantages described above may relate to one embodiment or may relate to several embodiments. The embodiments are not limited to those that solve any or all of the stated problems or those that have any or all of the stated benefits and advantages.

Any reference to 'an' item refers to one or more of those items. The term 'comprising' is used herein to mean including the method blocks or elements identified, but that such blocks or elements do not comprise an exclusive list and an apparatus may contain additional blocks or elements and a method may contain additional operations or elements. Furthermore, the blocks, elements and operations are themselves not impliedly closed.

The steps of the methods described herein may be carried out in any suitable order, or simultaneously where appropriate. The arrows between boxes in the figures show one example sequence of method steps but are not intended to exclude other sequences or the performance of multiple steps in parallel. Additionally, individual blocks may be deleted from any of the methods without departing from the spirit and scope of the subject matter described herein. Aspects of any of the examples described above may be combined with aspects of any of the other examples described to form further examples without losing the effect sought. Where elements of the figures are shown connected by arrows, it will be appreciated that these arrows show just one example flow of communications (including data and control messages) between elements. The flow between elements may be in either direction or in both directions.

The applicant hereby discloses in isolation each individual feature described herein and any combination of two or more such features, to the extent that such features or combinations are capable of being carried out based on the present specification as a whole in the light of the common general knowledge of a person skilled in the art, irrespective of whether such features or combinations of features solve any problems disclosed herein. In view of the foregoing description it will be evident to a person skilled in the art that various modifications may be made within the scope of the invention.

The invention claimed is:

1. A computer-implemented system for dynamically serving parking space requests for a vehicle, the system comprising:

one or more processors;

a memory configured to store computer-executable instructions, which when executed on the one or more processors configures the system to provide:

an input module for receiving a request for a parking space;

a search module for determining a plurality of suitable parking spaces based on the received request, the determining comprising:

selecting a region from a plurality of regions corresponding to a plurality of adjacent geographical areas, each of the regions being associated with an individual parking space prediction model adapted for that region, and the selection of the region being based on information derived from the request;

utilising the parking space prediction model of the selected region to determine the plurality of suitable parking spaces based on the information derived from the request;

an allocation module for selecting from the plurality of suitable parking spaces to allocate a parking space for the vehicle, the selection being performed based on a scoring a plurality of weighted selection criteria for each suitable parking space; and a transmission module for transmitting data indicative of the allocated parking space.

2. The system of claim 1, wherein the information derived from the request comprises a feature vector indicative of vehicle intent, vehicle entitlement, and vehicle constraint features.

3. The system of claim 1, wherein the vehicle intent feature comprises data relating to one or more of a desired parking distance to a location, a physical dimension of the parking space, a type of parking space, duration of parking, a cost of parking, and time and/or date of parking.

4. The system of claim 1, wherein the vehicle entitlement feature comprises data relating to one or more of a parking permission status and a vehicle priority status.

5. The system of claim 1, wherein the vehicle constraint feature comprises data relating to one or more of a physical characteristic of the vehicle or a vehicle accessibility feature.

6. The system of claim 1, wherein the parking space prediction model is arranged to minimize a Euclidean distance between the feature vector comprising the request and a plurality of feature vectors representing the parking spaces located within the corresponding region and select a plurality of suitable parking spaces with the lowest vector distances.

7. The system of claim 1, wherein each parking space prediction model is associated with an individual computation agent.

8. The system of claim 1, wherein the selection criteria comprises one or more of an occupancy metric, a prediction metric, a congestion metric, a local air quality metric, an emissions metric, and a space efficiency metric.

9. The system of claim 8, wherein the occupancy metric is determined based on receiving dimension data of a vehicle presently occupying a suitable parking space, and estimating the remaining space in the suitable parking space.

10. The system of claim 9, wherein the space efficiency metric is determined by calculating the likelihood that the space remaining in a parking space after occupancy by the vehicle can be used by other vehicles.

11. The system of claim 1, further comprising:

an arbitration module arranged to:

receive data indicative of a competing allocation of the final parking space by for a second request by a second vehicle;

assign priorities to the vehicle and second vehicle based on their respective requests; and re-select, for the vehicle with the lower assigned priority, from the plurality of suitable parking spaces to allocate an alternative parking space for said vehicle, the selection being performed based on a scoring a different plurality of weighted selection criteria for each suitable parking space.

12. The system of claim 1, further comprising a verification module arranged to verify occupancy of the allocated parking space by the vehicle.

13. A computer-implemented method for dynamically serving parking space requests for a vehicle, the method comprising:

receiving a request for a parking space;

determining a plurality of suitable parking spaces based on the received request, the determining comprising:

selecting a region from a plurality of regions corresponding to a plurality of adjacent geographical areas, each of the regions being associated with an individual parking space prediction model adapted for that region, and the selection of the region being based on information derived from the request;

utilising the parking space prediction model of the selected region to determine the plurality of suitable parking spaces based on the information derived from the request;

selecting from the plurality of suitable parking spaces to allocate a final parking space for the vehicle, the selection being performed based on a scoring a plurality of weighted selection criteria for each suitable parking space; and transmitting data indicative of the allocated final parking space.

14. The method of claim 13, further comprising: assigning priorities to the vehicle and a second vehicle responsive to receiving data indicative of a competing allocation of the final parking space by a second request for the second vehicle, and re-selecting, for the vehicle with the lower assigned priority, from the plurality of suitable parking spaces to allocate an alternative parking space for said vehicle, the selection being performed based on a scoring a different plurality of weighted selection criteria for each suitable parking space.

15. A non-transitory, computer-readable media comprising instructions which, when executed by a computer, cause the computer to perform steps, comprising:

receiving a request for a parking space;

determining a plurality of suitable parking spaces based on the received request, the determining comprising:

selecting a region from a plurality of regions corresponding to a plurality of adjacent geographical areas, each of the regions being associated with an individual parking space prediction model adapted for that region, and the selection of the region being based on information derived from the request;

utilising the parking space prediction model of the selected region to determine the plurality of suitable parking spaces based on the information derived from the request;

selecting from the plurality of suitable parking spaces to allocate a final parking space for the vehicle, the selection being performed based on a scoring a plurality of weighted selection criteria for each suitable parking space; and transmitting data indicative of the allocated final parking space.

16. The non-transitory, computer-readable media as recited in claim 15, wherein the instructions cause the computer to perform additional steps comprising: assigning priorities to the vehicle and a second vehicle responsive to receiving data indicative of a competing allocation of the final parking space by a second request for the second vehicle, and re-selecting, for the vehicle with the lower assigned priority, from the plurality of suitable parking spaces to allocate an alternative parking space for said vehicle, the selection being performed based on a scoring a different plurality of weighted selection criteria for each suitable parking space.

* * * * *